US005327585A

United States Patent [19]

Karlan

[11] Patent Number: 5,327,585

[45] Date of Patent: Jul. 12, 1994

[54] COOL CAP

[76] Inventor: Edward J. Karlan, 2199 Harrison, Medford, Oreg. 97504

[21] Appl. No.: 56,868

[22] Filed: May 5, 1993

[51] Int. Cl.[5] ..... A42C 5/02

[52] U.S. Cl. ..... 2/7; 2/171.2; 2/181; 2/195.5; 2/209.13; 2/DIG. 11; 607/114

[58] Field of Search ..... 2/7, 171.2, 181, 181.2, 2/181.4, 181.6, 181.8, 182.1, 182.2, 182.3, 182.5, 196, 199, 185 R, 209.1, 411, 412, 413, 414, DIG. 11; 62/259.3, 529, 530; 128/380, 399, 402, 403

[56] References Cited

U.S. PATENT DOCUMENTS

| | | | |
|---|---|---|---|
| 531,505 | 12/1894 | Brown | 2/199 |
| 2,875,447 | 3/1959 | Goldmerstein | 2/7 |
| 4,204,543 | 5/1980 | Henderson | 128/403 |
| 4,326,533 | 4/1982 | Henderson | 128/403 |
| 4,484,363 | 11/1984 | Varanese | 2/181.6 |
| 4,776,042 | 10/1988 | Hanson | 2/7 |
| 4,815,144 | 3/1989 | Martin | 2/171.2 |
| 5,088,549 | 2/1992 | Schneider | 2/7 |
| 5,119,513 | 6/1992 | McKay | 2/181 |
| 5,157,788 | 10/1992 | Schultz | 2/7 |

*Primary Examiner*—Clifford D. Crowder
*Assistant Examiner*—Diana L. Biefeld
*Attorney, Agent, or Firm*—Jacobson, Price, Holman & Stern

[57] ABSTRACT

An elongated, semi-flat tubular body constructed of flexible fluid impervious material is provided and the tubular body is divided into separate longitudinally spaced compartments along longitudinally spaced flexible transverse zones of the body. The compartments are filled with a fluid eutectic solution and the body may be folded along the transverse zones for relative angular displacement of the adjacent compartments. The elongated, semi-flat tubular body may removably supported within the channel defined by the sweat band of a hat or cap and may be used to absorb heat from the adjacent head areas of the wearer of the hat or to provide heat to those adjacent head areas.

7 Claims, 2 Drawing Sheets

COOL CAP

BACKGROUND OF THE INVENTION

1. Field of the Invention

This invention relates to a cap or hat construction wherein the sweat band area thereof is provided with a relatively flat tubular sleeve removably secured therein and extending appreciably thereabout and in which a flat tubular body constructed of flexible fluid impervious material is removably anchored, the tubular body containing a eutectic solution which may be chilled and thereby utilized to absorb heat from the head of the wearer of the cap or hat. In addition, the tubular body also may be filled with a material to be heated and thereby to provide heat to the headband area of the wearer of the cap or hat.

2. Description of Related Art

The Applicant herein, at the present time, is aware of only one hat liner which is designed with a replaceable thermal pack. This replaceable thermal pack is specifically designed for use in connection with a hard hat for industrial purposes and the radial shape thereof is not easy to install or manufacture. Also, it is bulky, has many seams, and is not specifically designed to cool the areas of the head most in need of being cooled (the forehead and temples) and it is not adaptable to other hats in a universal manner.

To overcome these shortcomings, the liner of the instant invention has been designed in a strip-like shape covering the areas of primary thermal function for the human body. Also, the lighter weight design is more comfortable. The pack is easier to install and remove. Also, the new thermal pack is easily attached to other styles of caps or hats such as baseball caps, thus allowing it to be stylish in more general usage.

SUMMARY OF THE INVENTION

The present invention comprises a strip-type liner to be attached or fastened to a hat, cap or helmet for cooling or heating purposes. The liner may be buttoned, snapped, sewed or hook and loop pile secured in place or otherwise attached to the hat, cap or helmet through the use of a liner to hold it in place, the liner being made of materials of a flexible nature designed with a flap that which may be buttoned, snapped, hook and loop pile secured or otherwise attached in an openable, reusable manner for the insertion of thermal packs therein. The liner also may contain a thermal barrier glued, sewn, or otherwise attached to the section of the liner between the insert pack and the hat, thus preventing unwanted heat flow and extending the usable time of the pack, the pack to be made of a flexible material with suitable heat flow characteristics for the purpose of containing a non-toxic heat absorbing/radiating material of flexible or fluid nature which has been heated or cooled to provide the wearer with the proper comfort in an otherwise uncomfortable environment. The thermal pack inserts into the liner for easy replacement when thermally expended and the pack is shaped to provide thermal aid primarily to certain areas of the head such as the forehead and temples. The pack also is shaped ergonomically such that the weight is evenly distributed around the head in a balanced form for comfort. Further, the pack is compartmented to aid in the flexibility thereof and its adaptation to the shape of the head.

The main object of this invention is to provide a thermal pack for use in the sweat band area of a hat, helmet or cap in absorbing heat from the wearer or providing heat to be absorbed by the wearer, depending upon the climatic conditions in which the headgear is being worn.

Another object of this invention is to provide a thermal pack for various forms of headgear which may be readily removably secured to the headgear such that a workman may carry with him several thermal packs in an insulated container enabling a thermal pack which has been thermally expended to be replaced by a second non-expended thermal pack.

Another very important object of this invention to be specifically enumerated herein is to provide a thermal headgear pack which will be readily adaptable for use in hats, caps and helmets without the bulkiness of previously known thermal packs designed to be utilized within hard hats.

Still another very important object of this invention is to provide a thermal pack for headgear which may be specifically designed to provide the desired heat transfer between the thermal pack and the forehead and temple areas of the user.

A final object of this invention to be specifically enumerated herein is to provide a thermal pack for headgear which will conform to conventional forms of manufacture, be of simple construction and easy to use so as to provide a device that will be economically feasible, long-lasting and relatively trouble-free in installation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
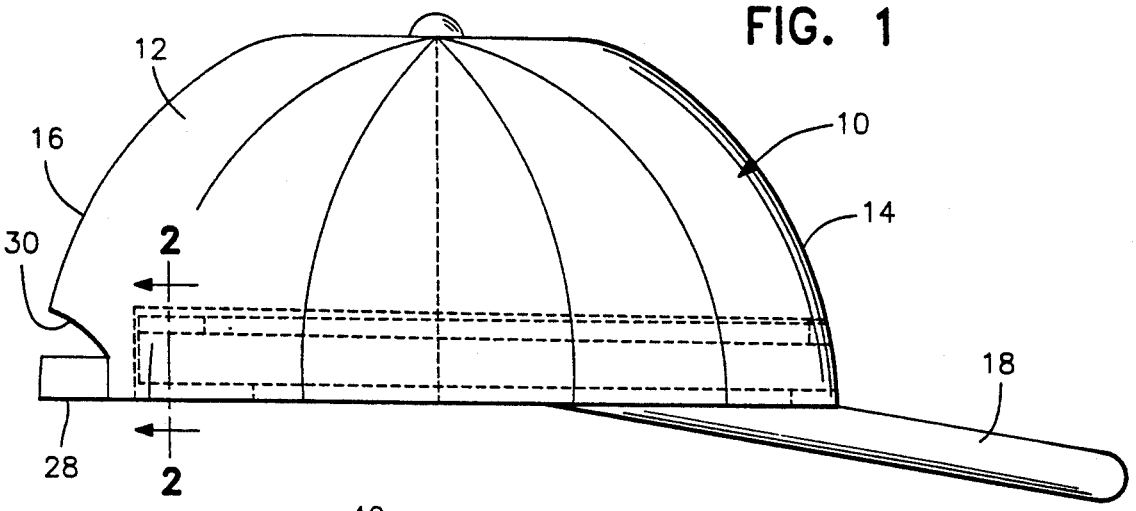
FIG. 1 is a side elevational view of a baseball-type cap incorporating the instant invention.
Figure 2:
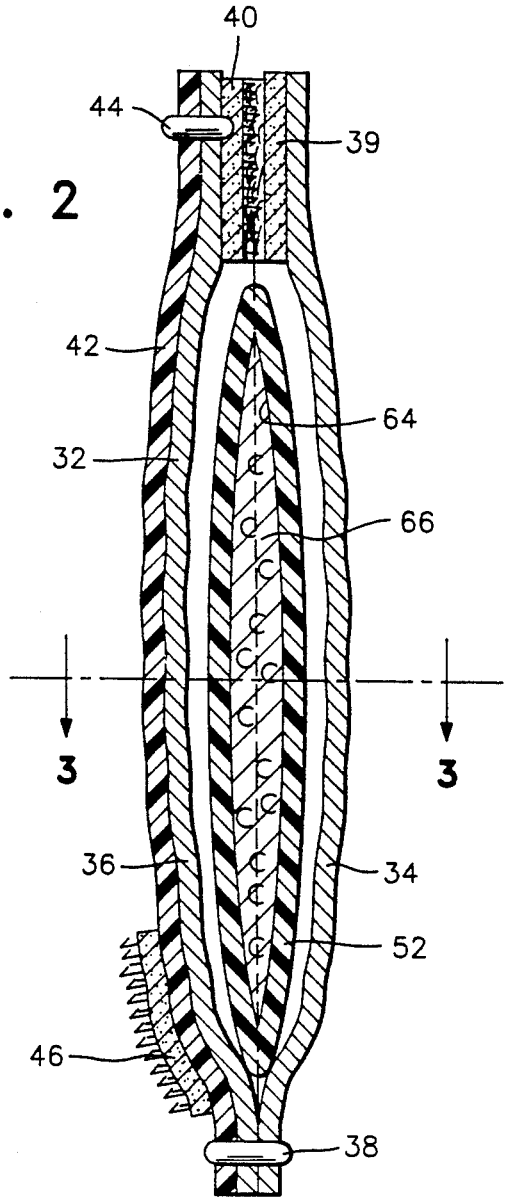
FIG. 2 is an enlarged fragmentary vertical sectional view taken substantially upon the plane indicated by the section line 2—2 of FIG. 1, but with the cap removed.
Figure 2A:
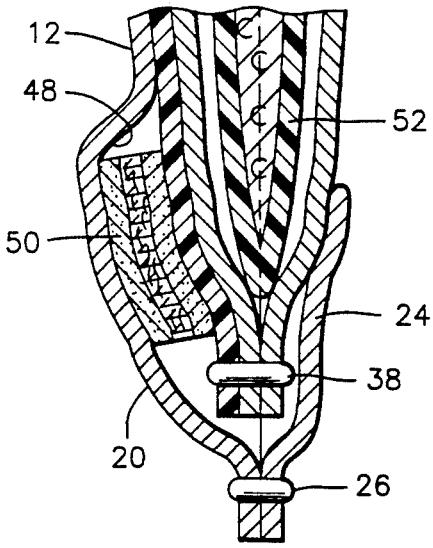
FIG. 2A is an enlarged fragmentary vertical sectional view similar to FIG. 2, but with the outer wall of the cap and the sweat band thereof illustrated.

Referring now more specifically to the drawings, the numeral 10 generally designates a conventional form of baseball-type cap including a downwardly opening crown 12 having front and rear sides 14 and 16. A bill 18 extends forwardly from the front side 14 and the lower margin 20 of the crown is sewn to an inner sweat band 24 as at 26. The cap 10 illustrated includes an adjustable length band 28 which may be adjusted according to the size of the head of the wearer.

The sweat band 24 extends around the lower periphery of the crown 12 to the rear opening 30 in the crown 12, which rear opening 30 is bridged by the adjustable length band 28.

The instant invention incorporates a felt material liner in the form of a flat tubular sleeve 32 incorporating inner and outer walls 34 and 36 sewn together as at 38 along their lower margins and which are removably secured together at points spaced along their upper margins through the utilization of co-acting hook and loop pile "VELCRO" material tabs 39 and 40. The outer wall 36 of the flat tubular sleeve 32 is covered by a plastic heat reflective and water impervious panel 42 sewn to the lower margin of the outer wall 36 as at 38 and to the upper margin of the outer wall as at 44, the various tabs and 40 being adhesively secured to the upper margins of the inner and outer walls 34 and 36.

In addition, longitudinally spaced lower portions of the outer wall 36 include hook-type tabs 46 secured thereto at points spaced longitudinally therealong and corresponding inner surface portions 48 of the lower margin 20 of the crown 12 have corresponding loop pile tabs 50 adhesively secured thereto.

Figure 3:
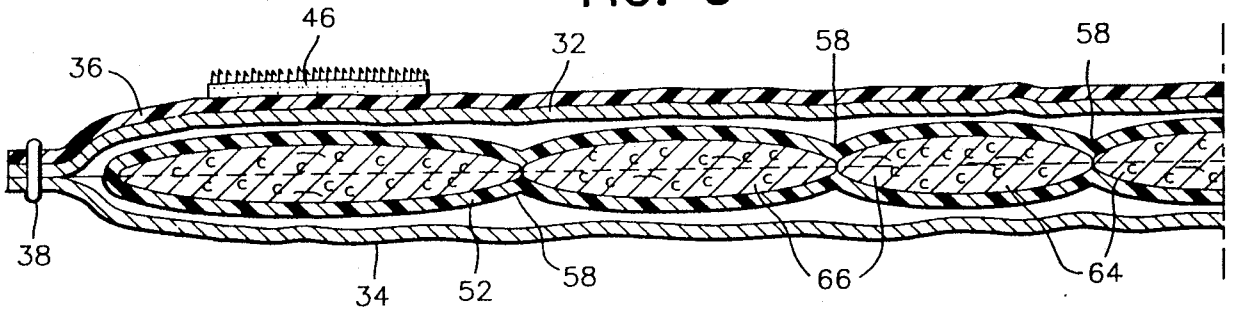
FIG. 3 is a fragmentary enlarged vertical sectional view taken substantially upon the plane indicated by the section line 3—3 of FIG. 2 and illustrating approximately one-half the length of the tubular sleeve and flat tubular body of eutectic solution disposed therein with all portions of the cap omitted.
Figure 3A:
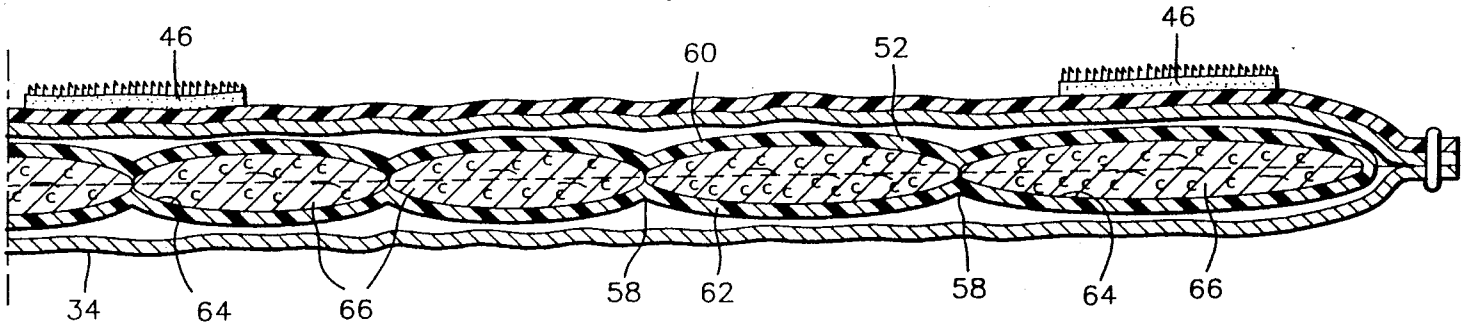
FIG. 3A is a fragmentary enlarged horizontal sectional view similar to FIG. 3 but illustrating the remainder of the length of the tubular sleeve and flat tubular body of eutectic solution.
Figure 4:
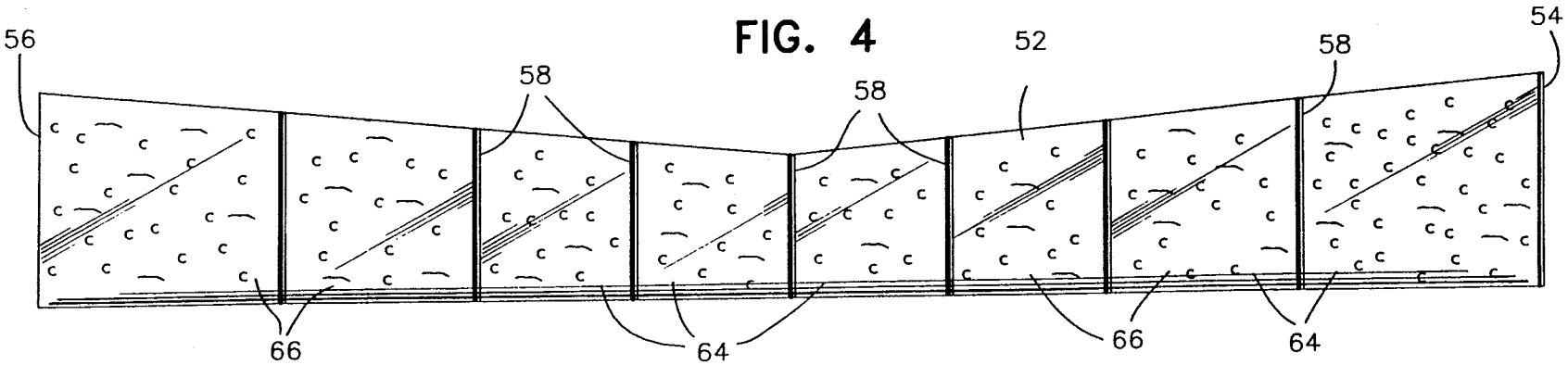
FIG. 4 is an elevational view of the flat tubular body of eutectic solution.

With attention now invited more specifically to FIGS. 3, 3A and 4, it may be seen that a flat tubular plastic body is provided and sealed at its opposite ends as at 54 and 56. In addition, the flat tubular body 52 includes longitudinally spaced transversely extending zones 58 spaced longitudinally therealong in which the opposite side walls 60 and 62 of the flat tubular body are adhered together by thermal welding, thereby dividing the tubular body 52 into eight individual compartments spaced therealong, the compartments 64 being partially filled with a eutectic solution 66.

It is proposed that a small insulated housing (not shown) will be provided for containing a plurality of the flat tubular bodies 52, perhaps in folded form, and that the folded bodies will be placed within the insulated housings after having been frozen or heated.

Then, as needed, the flat tubular sleeve is opened along the upper margin thereof and one of the flat tubular bodies may be removed from the insulated housing therefor and placed within the tubular sleeve, after which the latter is closed along its upper margins. In this manner, heat from the forehead area and the temple areas of the wearer of the cap 10 may be absorbed or increased.

The number of tubular bodies to be contained within the insulated housing may be sufficient to last through a full working day or work shift.

Also, it is to be noted that the tubular bodies, in cold weather, may be heated and contained within an insulated housing to thereby enable heat to be absorbed from the flat tubular body 52 by the forehead and temple areas of the wearer of the cap 10.

The foregoing is considered as illustrative only of the principles of the invention. Further, since numerous modifications and changes readily will occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A heat-absorbing/radiating hat defining a crown area for disposition over the head of a user and including front and rear sides and a headband area encircling, at least substantially, a lower peripheral portion of said crown area, said headband area defining an upwardly opening channel extending along said lower peripheral portion, an elongated, semi-flat tubular body constructed of flexible, fluid impervious material removably anchored in and extending along said channel, said tubular body including generally flat opposite side panels joined along corresponding longitudinal and end margins thereof with said tubular body partially filled with fluid eutectic material, a plurality of pairs of opposing narrow zones extending transversely of said panels between said longitudinal margins and spaced apart generally equally throughout the length of said tubular body with said opposing zones being internally bonded together to divide the interior of said tubular body into a plurality of separate compartments spaced longitudinally along said tubular body, each of said compartments being partially filled with said fluid eutectic material and said zones defining transverse zones of said semi-flat tubular body along which said body may be folded, slightly, to enable relative angular displacement of compartments of said body disposed on opposite sides of each of said zones, said tubular body extending lengthwise along said headband area throughout said front side and rearwardly along opposite sides of said lower peripheral portion of said crown area toward and terminating forwardly of said rear side, said semi-flat tubular body including opposite end portions and a longitudinal central zone, said central zone being of a vertical extent less than the vertical extent of the opposite end portions of said tubular body.

2. The hat of claim 1 including an elongated, flat, flexible and tubular felt sleeve removably secured in said channel, said tubular body being removably contained within said flexible sleeve, said flexible sleeve including an openable closed upper margin through which said tubular body may be inserted and removed.

3. The hat of claim 2, wherein said flexible sleeve is removably secured in said channel through the utilization of hook and loop fastening means.

4. The hat of claim 2, wherein said openable upper margin of said flexible sleeve is removably closed through the utilization of co-acting hook and loop tabs spaced along said upper margin.

5. The hat of claim 2, wherein said flexible sleeve includes inner and outer walls and said outer wall is covered by a flexible heat reflective and fluid impervious material panel.

6. The hat of claim 5, wherein said flexible sleeve includes an open upper margin through which said tubular body may be inserted and removed.

7. The hat of claim 5, wherein said flexible sleeve is removably secured in said channel through the utilization of hook and loop fastening means.

* * * * *